US006334238B2

(12) United States Patent
Hartung

(10) Patent No.: US 6,334,238 B2
(45) Date of Patent: Jan. 1, 2002

(54) METHOD OF OPERATING A DRAW UNIT OF A SPINNING PREPARATION MACHINE

(75) Inventor: Reinhard Hartung, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/734,038

(22) Filed: Dec. 12, 2000

Related U.S. Application Data

(63) Continuation of application No. 09/585,545, filed on Jun. 2, 2000, now abandoned.

(30) Foreign Application Priority Data

Jun. 2, 1999 (DE) ..... 199 25 271

(51) Int. Cl.[7] ..... D01H 5/00
(52) U.S. Cl. ..... 19/236; 19/240; 19/260
(58) Field of Search ..... 19/236, 240, 258, 19/260, 293, 0.2, 0.21, 0.22; 66/207; 700/139, 141, 142

(56) References Cited

U.S. PATENT DOCUMENTS 5,018,248 A * 5/1991 Haworth et al. ..... 19/236
5,161,284 A * 11/1992 Leifeld ..... 19/260
5,307,648 A * 5/1994 Forkert et al. ..... 66/207
5,311,751 A * 5/1994 Winter et al. ..... 66/207
5,311,752 A * 5/1994 Gille ..... 66/207
5,438,733 A * 8/1995 Melcher et al. ..... 19/293
5,473,913 A * 12/1995 Bogucki-Land ..... 66/207
5,544,390 A * 8/1996 Hartung et al. ..... 19/240
5,991,977 A * 11/1999 Weber ..... 19/258

FOREIGN PATENT DOCUMENTS

| | | |
|---|---|---|
| DE | 36 22 584 | 9/1994 |
| DE | 43 32 249 | 3/1995 |
| DE | 38 01 880 | 4/1995 |
| DE | 195 17 757 | 11/1996 |
| DE | 41 40 984 | 9/1997 |
| DE | 196 44 560 | 4/1998 |

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A method of operating a sliver draw unit of a spinning preparation machine includes the following steps: applying, by incremental rotary displacement sensors, signals to an electronic control and regulating device; determining from the signals the angular position and/or the rotary direction of at least one of the roll pairs of the draw unit during operation and standstill; and rotating at least one of the roll pairs into a predetermined angular position by controlling the electric motor driving that roll pair.

13 Claims, 3 Drawing Sheets

METHOD OF OPERATING A DRAW UNIT OF A SPINNING PREPARATION MACHINE

CROSS REFERENCE TO RELATED APPLICATION

This application is a continuation of application Ser. No. 09/585,545 filed Jun. 2, 2000 now ABN.

This application claims the priority of German Application No. 199 25 271.8 filed Jun. 2, 1999, which is incorporated herein by reference.

BACKGROUND OF THE INVENTION

This invention relates to a draw unit for a spinning preparation machine, particularly a regulated draw frame for cotton or chemical fibers and the like. The draw unit has at least two consecutively arranged roll pairs each having a driven roll provided with its own electromotor as well as an electronic control and regulating device to which the electromotors are connected. A respective incremental rotational displacement sensor is coupled with the driven rolls.

In a known draw unit, as disclosed in German patent document No. 196 44 560, to which corresponds U.S. Pat. No. 5,991,977, a device for preventing a reverse rotation during standstill is associated with the lower input roll.

SUMMARY OF THE INVENTION

It is an object of the invention to provide an improved method of operating a draw unit of the above-outlined type in which, upon reverse rotation of the rolls during standstill the predetermined extent of draw of the sliver bundle is preserved in a simple manner.

This object and others to become apparent as the specification progresses, are accomplished by the invention, according to which, briefly stated, the method of operating a sliver draw unit of a spinning preparation machine includes the following steps: applying, by incremental rotary displacement sensors, signals to an electronic control and regulating device; determining from the signals the angular position and/or the rotary direction of at least one of the roll pairs of the draw unit during operation and standstill; and rotating at least one of the roll pairs into a predetermined angular position by controlling the electric motor driving that roll pair.

The incremental rotary displacement sensors are associated with the rolls at the input and with the rolls at the output of the draw unit whereby a highly responsive monitoring of the rpm and the direction of rotation of the rolls is possible to thereby permit suitable countermeasures or intervention. In particular, an undesired reverse rotation of the intake roll or the intake and mid roll is compensated for by a slight forward rotation during standstill of the outlet rolls so that locations of reduced thickness or even ruptures in the sliver are avoided. The predetermined draft of the sliver is maintained during standstill even in case of a possible reverse rotation of the input roll. The forward rotation of the intake roll causes the sliver to sag slightly which is harmless. Then, in case of a reverse rotation, the sagging region is simply pulled straight without causing a reduction in the sliver thickness or a rupture. It is a further particular advantage of the invention that based on the known position of the rolls in operation, during standstill and after switching off the machine, particularly the drive motors, the overhanging sliver is first pulled taut or set in a simple manner with the aid of the controlled motors. Thereafter the rolls are accelerated to the operational rpm, and the sliver is accelerated to the operational speed while maintaining the predetermined draft (despite an undesired reverse rotation of the intake roll that may occur). The invention eliminates the need for a mechanical or an electromechanical lock to prevent a reverse roll rotation.

The invention has the following additional advantageous features:

- The electronic control and regulating device may set the sliver in or upstream of the draw unit to a predetermined draft by a suitable rpm control of the drive motor or drive motors.
- During standstill of the output roll, the input roll or the input roll and the mid roll continue to rotate forward to a small predetermined extent.
- The extent of the forward rotation equals at least the extent of the reverse rotation of the rolls caused by a relaxation of the sliver during standstill.
- After reaching the predetermined forward rotation, the input roll or the input roll and the mid roll is placed in a standstill state.
- The input rolls or the input rolls and the mid rolls and the output rolls are braked to assume standstill and subsequently the input roll or the input roll and the mid roll are slightly accelerated in the working (forward) direction.
- When the machine is stopped and after the standstill state is reached, the principal electric motor (driving the output roll pair) is turned off, and then the regulating electric motor (driving the input roll pair or the input roll pair and the mid roll pair) is switched on and is subsequently switched off.
- Upon stopping the machine the rpm of the principal motor is reduced to zero from the operational rpm and the rpm of the regulating motor is first reduced to a value greater than zero and thereafter is reduced to zero.
- Upon turning on the motors the roll rpm's are set to correspond to a predetermined draft of the sliver.
- Upon turning on the motors, deviations from the predetermined positions (desired values) are compensated for.
- The output rolls are brought into a predetermined position.
- The input rolls or the input rolls and the mid rolls are brought into a predetermined position.
- After setting the rolls to predetermined (desired) positions, the rolls are accelerated to the operating rpm.
- The predetermined rotary displacement is between zero and 4 mm.

The predetermined rotary displacement is zero; the reverse rotation may be eliminated by a slight acceleration in the working direction.

- The predetermined rotary displacement is zero; the reverse rotation corresponds to the small rotary displacement in the working direction.
- The displacement of the sliver in the working direction is approximately between 0.1 and 4 mm.

The sliver is accelerated in the principal draw field during standstill of the output rolls by a small rotation of the input roll or the input roll and the mid roll.

DESCRIPTION OF THE PREFERRED EMBODIMENT

Figure 1A:
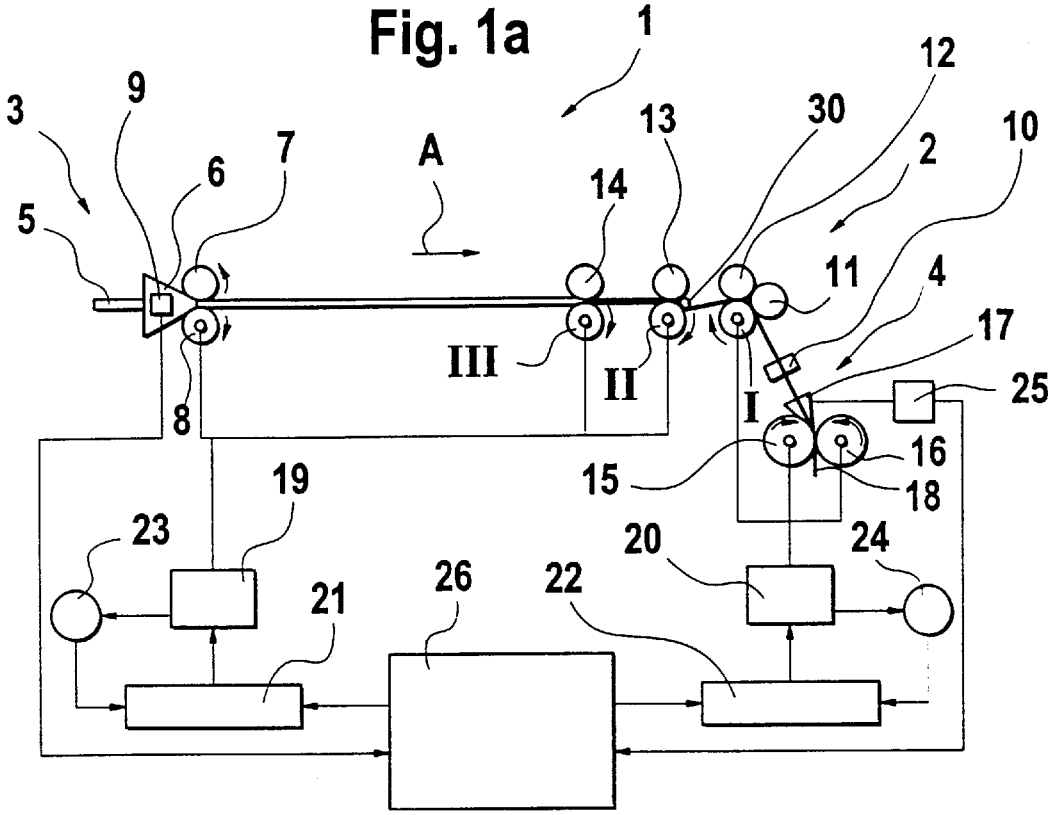
FIG 1*a* is a schematic side elevational view of a regulated draw frame for practicing the invention.

FIG. 1*a* illustrates a draw frame 1 which may be an HSR model manufactured by Trützschler GmbH & Co. KG, M önchengladbach, Germany. The draw frame 1 includes a draw unit 2 having a draw unit inlet 3 and a draw unit outlet 4. The slivers 5 are taken from non-illustrated coiler cans, they are introduced into a sliver guide 6 and, pulled by the withdrawing roll pair 7, 8, they are advanced through a measuring member 9. The draw unit 2 is a 4-over-3 construction, that is, it has three lower rolls, namely, a lower output roll I, a lower mid roll II and a lower input roll III, as well as four upper rolls 11, 12, 13 and 14. The working direction of the draw unit 2 is designated at A.

Figure 1B:
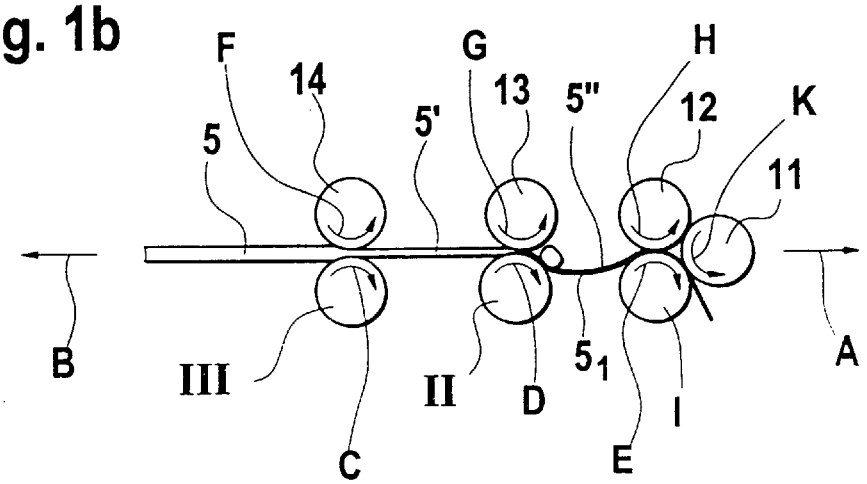
FIG. 1*b* is an enlarged partial schematic side elevational view of roll pairs of FIG. 1*a*.

Also referring to FIG. 1*b,* in the draw unit 2 the sliver bundle portion 5' is drawn in a preliminary drawing field and the sliver bundle portion 5" is drawn in the principal drawing field. The roll pairs 14, III and 13, II form the preliminary drawing field whereas the roll pair 13, II and the roll assembly 11, 12, I form the principal drawing field. The drawn slivers 5 are admitted in the draw unit outlet 4 to a sliver guide 10 and are pulled by delivery rolls 15, 16 through a sliver trumpet 17 in which the slivers are combined into a drawn sliver 18 which is subsequently deposited in coiler cans.

The withdrawing rolls 7, 8, the lower input roll III and the lower mid roll II which are mechanically connected to one another, for example, by a toothed belt, are driven by a regulating motor 19 whose rpm may be based on an inputted desired value. The upper rolls 13 and 14 co-rotate with their respective lower rolls. The lower output roll I and the withdrawing rolls 15, 16 are driven by a principal motor 20. The regulating motor 19 and the principal motor 20 are each provided with a respective regulator 21 and 22. The regulation (rpm regulation) is effected by a closed regulating circuit. The regulating motor 19 and the principal motor 20 are associated with a respective tachogenerator 23 and 24. At the draw unit outlet 4 the cross section of the exiting sliver 18 is determined by an outlet measuring member 25 disposed at a sliver trumpet 17. A central computer unit 26 (control and regulating device), for example, a microcomputer including a microprocessor, applies the desired setting values for the regulating motor 19 to the regulator 21. The measuring values of both measuring members 9 and 25 are applied to the control and regulating device 26 during the drawing operation. The desired value for the regulating motor 19 is determined in the central computer unit 26 from the measuring values of the inlet measuring member 9 and the desired value for the cross section of the exiting sliver 18. The measuring magnitudes of the outlet measuring member 25 serve for monitoring the exiting sliver 18. With the aid of the regulating system fluctuations in the cross section of the inputted slivers 5 may be compensated for by a suitable regulation of the drawing process to thus obtain an evening of the sliver 18. A pressing bar 30 is provided in the principal draw field for deflecting the sliver bundle 5".

In FIG. 1*b* the arrow B indicates the undesired direction of motion of the sliver bundle 5, 5', 5" as relaxation of the sliver bundle takes place during standstill. The arrows C, D, E, F, G, H and K show, during operation, the direction of rotation of the respective rolls III, II, I, 14, 13, 12 and 11.

According to the invention, after all rolls of the draw unit 2 are braked to a standstill, the input rolls III, 14 and the mid rolls II, 13 are accelerated slightly in the working direction A, while the output rolls I, 12, 11 remain stationary. As a result, the entire sliver bundle 5, 5', 5" is slightly shifted in the working direction A, for example, to an extent of 3 to 4 mm, whereby the sliver bundle portion 5" is relaxed in the principal draw field and may sag slightly as indicated at $\mathbf{5}_1$. Upon an undesired reverse rotation of the rolls III, 14 and II, 13—that is, a rotation in a direction opposite the arrows C, D, F and G—and thus upon an undesired motion of the sliver bundle in the direction B, the sliver bundle 5" is merely straightened without interfering with its structure and particularly, without interfering with the drawing thereof.

Figure 2:
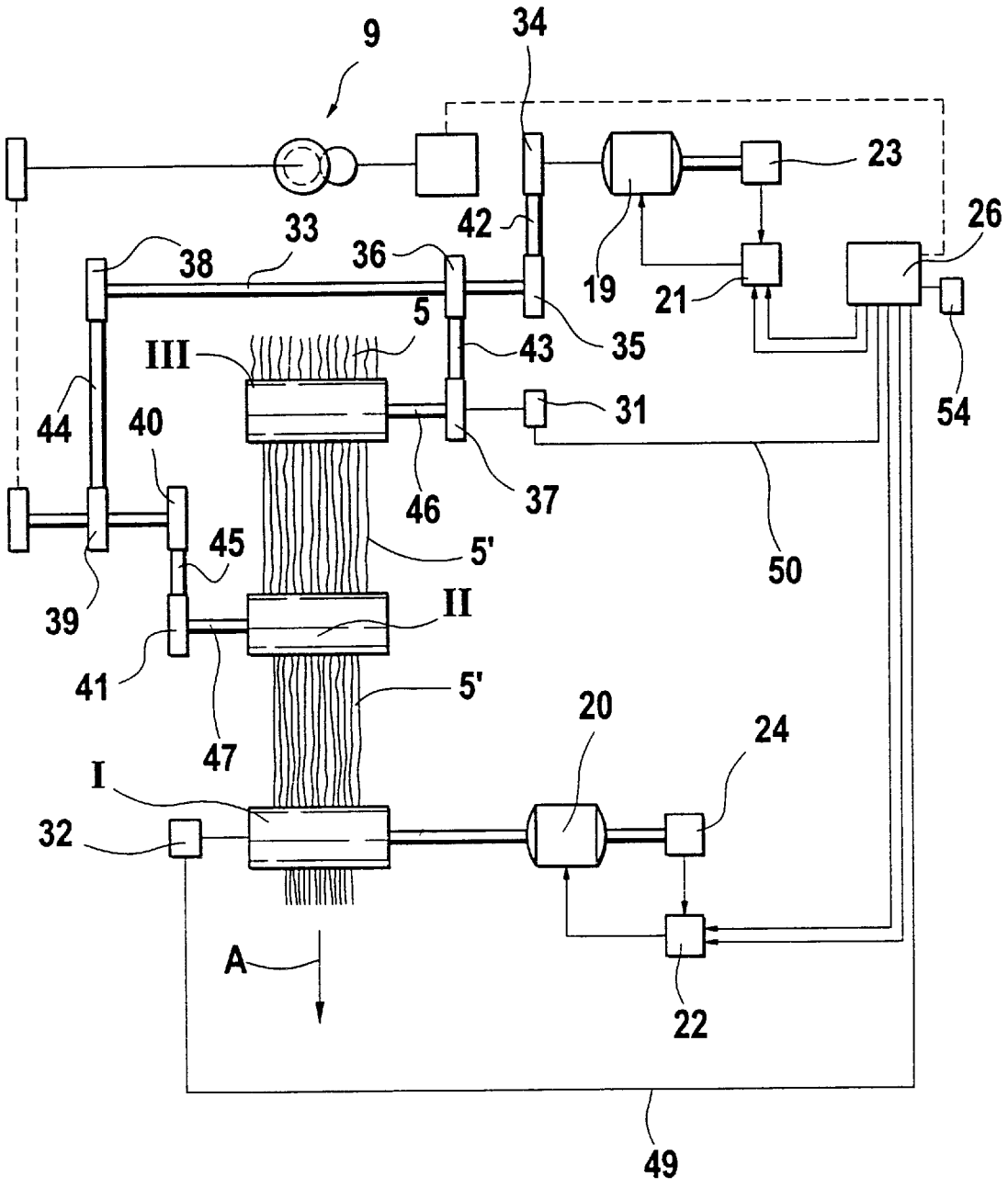
FIG. 2 is a schematic top plan view of the lower rolls of the draw unit of FIG. 1*a,* including a block diagram.

Turning to the schematic top plan view of FIG. 2, the lower input roll III and the lower mid roll II are coupled to one another with a gearing whose transmission ratio corresponds to a predetermined preliminary draw. The lower input roll III and the lower output roll I are coupled with respective incremental rotary displacement sensors 31 and 32. The rpm's of the regulating electric motor 19 and the main electric motor 20 are regulated by the control and regulating device 26 in such a manner that in the principal drawing field between the mid roll pair II, 13 and the output roll assembly I, 11, 12 a draft up to the desired fine value occurs while, at the same time, mass fluctuations of the incoming sliver bundle 5 are compensated for to the extent possible.

With further reference to FIG. 2, the electric motor 19 drives the two rolls III and II via a common transmission shaft 33. The transmission stages include toothed belts and gears transmitting the torque from the shaft 33 to the shafts 46 and 47 of the respective rolls III and II. The transmission gears interposed between the motor 19 on the one hand and the rolls II, III, on the other hand, are designated at 34–41 whereas the drive belts are designated at 42–45. The incremental rotary displacement sensor 32 associated with the lower output roll I and the incremental rotary displacement sensor 31 associated with the lower input roll III are connected by respective conductors 49 and 50 with the control and regulating device 26 to which a memory 54 is connected. In the arrangement shown in FIG. 2, the control and regulating device 26 may be a microcomputer which serves for controlling the machine operation and also serves for regulation to compensate for product irregularities. In particular, the electronic control and regulating device 26 is utilized for performing the method according to the invention. The lower rolls III, II, I have a respective rpm of, for example, 1400, 2000 and 7200 and a respective diameter of, for example, 35 mm, 35 mm and 40 mm. At the output of the roll assembly I, 11, 12 the running speed of the sliver is approximately 900 m/min at an rpm of 7200 of the lower output roll I.

Figure 3:
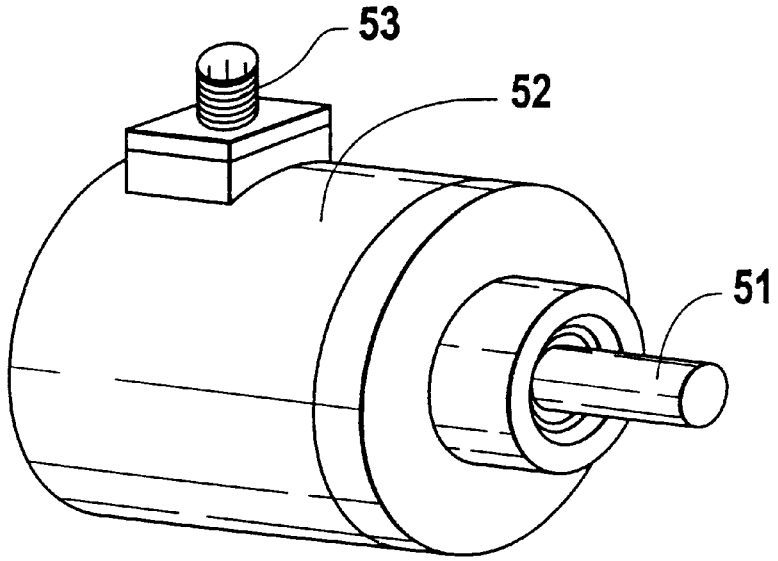
FIG. 3 is a perspective view of an incremental rotary displacement sensor.

The task to compensate for a reverse rotation of the rolls III, 14 and II, 13 during standstill of the machine is achieved by means of the incremental rotary displacement sensors 31 and 32, in conjunction with the electronic control and regulating device 26. A reverse rotation occurs practically always and is caused by the relaxation of the sliver bundle and the drive belts upon machine stoppage. The incremental rotary displacement sensors 31 and 32 (illustrated in FIG. 3) generate a pulse series whose frequency is proportional to the rpm of the roll to be monitored. The rotary displacement sensors 31, 32 are of the type by means of which the direction of rotation, the angular position, the rpm and the speed of the roll may be determined. Expediently, a magnetic incremental rotary displacement sensor 31, 32 is used in which a measuring shaft 51 and an encapsulated measuring head 52 are provided. The electric output of the sensor is designated at 53.

Figure 4:
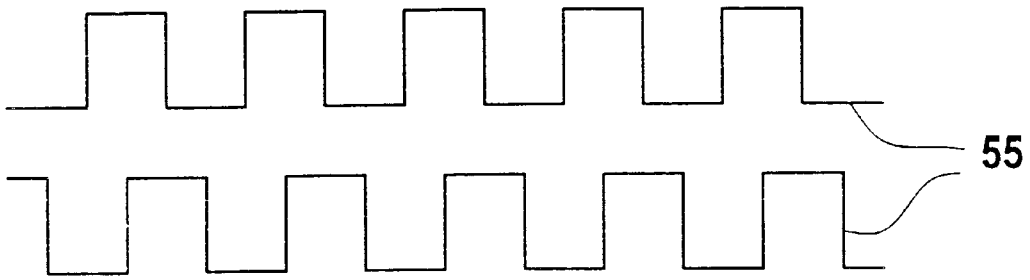
FIG. 4 illustrates a signal pattern of the incremental rotary displacement sensor of FIG. 3.

As shown in FIG. 4, two sinusoidal signals 55 whose phase is shifted by 90° are converted into square wave pulses in a 1:1 frequency ratio and are emitted at two outputs whereby a rotational differentiation is feasible.

The measures according to the invention render additional mechanical aids such as freewheeling clutches or motor brakes unnecessary. For performing the invention, a high-resolution detection of the rpm's and the angular position of the roll axes in the draw unit need to be obtained. Such a detection is effected by the rotary displacement sensors 31, 32 at the input and output rolls of the draw unit.

During operation, first the drives are braked until stoppage of the output roll I in the draw unit 2. A reverse rotation of the input roll III would lead to a thickness reduction in the sliver. To prevent such an occurrence, prior to switching off the drives, the input roll III (driven by the regulating motor 19) is, while the output roll I is stationary, further driven for an additional determined forward angular displacement to feed the sliver in the direction A. As a result, the sliver is relaxed in the principal drawing field and the reverse rotation of the input roll III upon switching off the drive is thus compensated for. Since upon switching off the drives the angular position of the rotary shafts in the draw unit change, the position of the roll shafts is detected by the rotational displacement sensors 31, 32 even during standstill, that is, after switching off the drives. After again switching on the drives, these positional changes are first compensated for and thereafter the operating rpm's of the machine are set.

The invention was described in connection with an example of a slight forward rotation in the working direction A of the input roll III or, in case of a mechanical coupling, the input roll III and mid roll II, while the output roll I is stationary. It is to be understood that the invention also includes an embodiment in which a slight reverse rotation against the working direction A—that is, in the direction B according to FIG. 1*b*—of the output roll I is effected while the input roll III or (upon mechanical coupling) the input roll III and the mid roll II are stationary.

It will be understood that the above description of the present invention is susceptible to various modifications, changes and adaptations, and the same are intended to be comprehended within the meaning and range of equivalents of the appended claims.

What is claimed is:

1. A method of operating a sliver draw unit of a spinning preparation machine; the draw unit including a first and a second pair of draw rolls through which the sliver consecutively passes in a forward direction while the rolls rotate in a working direction;

a first and a second electric motor drivingly connected to respective said first and second pairs of draw rolls;

a respective incremental rotary displacement sensor connected to each electric motor; and an electronic control and regulating device connected to said first and second electric motors and said incremental rotary displacement sensors; said method comprising the steps of (a) applying, by the incremental rotary displacement sensors, signals to said electronic control and regulating device;

(b) determining from said signals, by said electronic control and regulating device, at least one of the angular position and the rotary direction of at least one of said roll pairs during operation and during standstill; and (c) rotating at least one of said roll pairs into a predetermined angular position by controlling, by said electronic control and regulating device, at least one of said first and second motors.

2. The method as defined in claim 1, wherein said first pair of draw rolls is an input roll pair and said second pair of draw rolls is an output roll pair; further comprising the step of continuing to rotate the input roll pair through a predetermined displacement in the forward direction during standstill of said output roll pair.

3. The method as defined in claim 2, further comprising a third pair of draw rolls through which the sliver passes and which is a middle roll pair disposed between said input roll pair and said output roll pair; further comprising the step of continuing to rotate the middle roll pair through said predetermined angle in the forward direction during standstill of said output roll pair in synchronism with said input roll pair.

4. The method as defined in claim 2, wherein said predetermined angle has at least a magnitude equaling an angle of reverse rotation of the rolls caused by a relaxation of the sliver during standstill.

5. The method as defined in claim 2, further comprising the steps of (a) stopping the machine;

(b) simultaneously with said stopping step, reducing the rpm of the second electric motor to zero and reducing the rpm of said first electric motor to less than zero; and (c) subsequent to said reducing step, reducing the rpm of said first electric motor to zero.

6. The method as defined in claim 2, further comprising the step of accelerating said input roll pair upon reverse rotation of the rolls caused by a relaxation of the sliver during standstill.

7. The method as defined in claim 2, wherein said rotary displacement is 4 mm at the most.

8. The method as defined in claim 2, wherein said predetermined angle has a magnitude equaling an angle of reverse rotation of the rolls caused by a relaxation of the sliver during standstill.

9. The method as defined in claim 1, wherein said first pair of draw rolls is an input roll pair and said second pair of draw rolls is an output roll pair; further comprising the step of placing said input roll pair into standstill after said predetermined angular position is reached.

10. The method as defined in claim 1, wherein said first part of draw rolls in an input roll pair and said second pair of draw rolls is an output roll pair; further comprising the step of braking said input and output roll pair to a standstill and subsequently accelerating said input roll pair as part of said step of continuing to rotate said input roll pair.

11. The method as defined in claim 1, wherein said determining step comprises the step of determining an rpm of at least one of said roll pairs during operation and during standstill.

12. The method as defined in claim 1, wherein said first pair of draw rolls is an input roll pair and said second pair of draw rolls is an output roll pair; further comprising the step of continuing to rotate the output roll pair through a predetermined displacement in a reverse direction during standstill of said input roll pair.

13. A method of operating a sliver draw unit of a spinning preparation machine; the draw unit including a first and a second pair of draw rolls through which the sliver consecutively passes in a forward direction while the rolls rotate in a working direction;

respective electric motors drivingly connected to respective said first and second pairs of draw rolls;

a respective incremental rotary displacement sensor connected to each electric motor; and an electronic control and regulating device connected to said first and second electric motors and said incremental rotary displacement sensors; said method comprising the steps of (a) applying, by the incremental rotary displacement sensors, signals to said electronic control and regulating device;

(b) determining from said signals, by said electronic control and regulating device, at least one of the angular position and the rotary direction of at least one of said roll pairs during operation and during standstill;

(c) stopping one of said first and second roll pairs; and (d) rotating the other of said first and second roll pairs into a predetermined angular position by controlling, by said electronic control and regulating device driving said other of said first and second roll pairs; said rotating step comprising the step of rotating said other of said first and second roll pairs in a direction to feed the sliver toward said one of said first and second roll pairs during standstill of said one of said first and second roll pairs.

* * * * *